US009783747B2

(12) United States Patent
Gattupalli et al.

(10) Patent No.: US 9,783,747 B2
(45) Date of Patent: Oct. 10, 2017

(54) PROCESS FOR DESULFURIZATION OF NAPHTHA USING IONIC LIQUIDS

(71) Applicant: UOP LLC, Des Plaines, IL (US)

(72) Inventors: Rajeswar R. Gattupalli, Arlington Heights, IL (US); Soumendra M. Banerjee, Dwarka (IN); Christopher P. Nicholas, Evanston, IL (US); Alakananda Bhatacharyya, Glen Ellyn, IL (US)

(73) Assignee: UOP LLC, Des Plaines, IL (US)

( * ) Notice: Subject to any disclaimer, the term of this patent is extended or adjusted under 35 U.S.C. 154(b) by 377 days.

(21) Appl. No.: 13/928,578

(22) Filed: Jun. 27, 2013

(65) Prior Publication Data

US 2015/0001135 A1 Jan. 1, 2015

(51) Int. Cl.

| | |
|---|---|
| ***C10G 67/04*** | (2006.01) |
| ***C10G 21/24*** | (2006.01) |
| ***C10G 45/04*** | (2006.01) |
| ***C10G 21/20*** | (2006.01) |

(52) U.S. Cl.

CPC ..... *C10G 67/04* (2013.01); *C10G 21/20* (2013.01); *C10G 21/24* (2013.01); *C10G 45/04* (2013.01); *C10G 2300/202* (2013.01)

(58) Field of Classification Search

CPC ..... C10G 55/04; C10G 67/04; C10G 21/24; C10G 55/06; C10G 21/28; C10G 21/20; C10G 2300/202; C10G 45/04

See application file for complete search history.

(56) References Cited

U.S. PATENT DOCUMENTS

| | | | | |
|---|---|---|---|---|
| 6,913,688 | B2 | 7/2005 | Coker et al. | |
| 2002/0175108 | A1* | 11/2002 | Debuisschert et al. | 208/57 |
| 2003/0188992 | A1 | 10/2003 | Halbert et al. | |
| 2005/0284794 | A1 | 12/2005 | Davis et al. | |
| 2009/0120841 | A1* | 5/2009 | Serban | C10G 21/20 208/209 |
| 2010/0270211 | A1 | 10/2010 | Wolny | |
| 2011/0000823 | A1 | 1/2011 | Hamad et al. | |
| 2011/0233113 | A1* | 9/2011 | Koseoglu | C10G 21/08 208/97 |
| 2013/0153464 | A1 | 6/2013 | Mezza et al. | |

FOREIGN PATENT DOCUMENTS

| | | | | |
|---|---|---|---|---|
| CN | 101824335 A | * | 9/2010 | C10G 53/14 |
| CN | 102690676 A | | 5/2012 | |
| CN | 102732289 A | | 7/2012 | |
| CN | 102746874 A | | 10/2012 | |

OTHER PUBLICATIONS

X. Jiang, et al., Imidazoliuym-based alkylphosphate ionic liquids—A potential solvent for extractive desulfurization of fuel, Fuel, vol. 87, No. 1, Elsevier, p. 79-84.*

(Continued)

*Primary Examiner* — Renee Robinson
*Assistant Examiner* — Derek Mueller

(57) ABSTRACT

A process has been developed in which some of the sulfur in a naphtha feed is removed using ionic liquids. The ionic liquid desulfurization step, which operates at low temperatures and pressures, is followed by a catalytic hydrodesulfurizaton step.

18 Claims, 5 Drawing Sheets

(56) References Cited

OTHER PUBLICATIONS

Compilation of Air Pollutant Emission Factors, vol. I: Stationary Point and Area Sources, AP-42, 1995, U.S. Environmental Protection Agency [hereinafter E.P.A].*
Search Report dated Oct. 16, 2014 for corresponding PCT Appl. No. PCT/US2014/042828.
Zhao et al. "Extraction-oxidation desulfurization . . . ," Gaodeng Xuexiao Huaxue Xuebao (2010), 31(3), pp. 488-491.
Ke et al,"Study on application of ionic . . . ," Xinan Shiyou Daxue Xuebao, Ziran Kexueban (2010), 32(3), pp. 145-149.
Ma, Weida, "Progress of gasoline . . . ," Guangzhou Huagong (2012), 40(11), pp. 65-66.
Zhang et al., "Explorign study on sulfur transfer . . . ," Shandong Huagong (2011), 40(10), pp. 32-35.
Zhao et al., "Desulfurization of gasoline with ionic liquid," Huaxue Gongcheng (Xi'an, China) (2010), 38(1), pp. 1-4.
Li et al., "Deep Extractive Desulfurization of Gasoline . . . ," Energy & Fuels (2010), 24(8), pp. 4285-4289.
Huang et al., "Reducing sulfur content in FCC . . . ," Huagong Jinzhan (2004), 23 (3), pp. 297-299.
Zhang et al., "FCC naptha desulfurization with complexing . . . ," Lianyou Jishu Yu Gongcheng (2005), 35(5), pp. 35-38.
Liu et al., "FCC naptha desulfurization via alkylation . . . ," Shiyou Lianzhi Yu Huagong (2006), 37(10), pp. 22-26.
Wang et al., "Advances on desulfurization of motor . . . ," Huagong Keji (2007), 15(3), pp. 51-55.
Liu et al., "Study of extraction desulfurization capability . . . ," Shiyou Yu Tianranqi Huagong (2007), 36(5), pp. 377-381.

* cited by examiner

PROCESS FOR DESULFURIZATION OF NAPHTHA USING IONIC LIQUIDS

BACKGROUND OF THE INVENTION

Environmental laws and international standards for the quality of diesel and gasoline have set the sulfur content in diesel and gasoline to less than 50 ppm in most countries. Catalytic hydrodesulfurization is a widely used technology for desulfurization of gasolines in the refining industry.

FIG. 1 illustrates one embodiment of a one stage catalytic hydrodesulfurization process 5. The feed 10 is preheated in a heat exchanger 15 and mixed with hydrogen 20. The feed 10 and hydrogen 20 are introduced into reactor 25 where any dienes present are saturated. The effluent 30 is mixed with hydrogen 20 and sent to heater 35. The heated mixture 40 is mixed with hydrogen 20 and sent to the catalytic hydrodesulfurization reactor 45 where the sulfur content is reduced. The effluent 50 is sent to product separator 55 where the gas 60 is separated from the low sulfur liquid 65. The recovered hydrogen rich gas 60 is sent to a recycle gas scrubber 70 for hydrogen sulfide removal, and the cleaned hydrogen gas 20 is recycled back to the reactor. Hydrogen sulfide is removed in stream 75. The low sulfur liquid 65 is sent to a debutanizer 80 where the light ends 85 are separated from the low sulfur naphtha 90. Make-up hydrogen 22 can be added as needed.

FIG. 2 illustrates one embodiment of a two stage catalytic hydrodesulfurization process 105. The feed 110 is preheated in a heat exchanger 115 and mixed with hydrogen 120. The feed 110 and hydrogen 120 are introduced into reactor 125 where any dienes present are saturated. The effluent 130 is mixed with hydrogen 120 and sent to heater 135. The heated mixture 140 is sent to the first stage catalytic hydrodesulfurization reactor 145 where the sulfur content is reduced. The effluent 150 is sent to an interstage separator 155 where the gas 160 is separated from the low sulfur liquid 165. The hydrogen rich gas 160 is sent to a recycle gas scrubber 170 for hydrogen sulfide removal, and the cleaned hydrogen gas 120 is recycled back to the reactor. Hydrogen sulfide is removed in stream 175. The low sulfur liquid 165 is mixed with hydrogen 120 and sent to the second stage catalytic hydrodesulfurization reactor 180 where the sulfur content is further reduced. The effluent 185 from the second stage catalytic hydrodesulfurization reactor 180 is sent to product separator 190 where the gas 195 is separated from the low sulfur liquid 200. The gas 195 from the second stage is mixed with the gas 160 from the first stage catalytic hydrodesulfurization reactor 145 and sent to the recycle gas scrubber 170. The low sulfur liquid 200 is sent to a debutanizer 205 where the light ends 210 are separated from the low sulfur naphtha 215. Make-up hydrogen 122 can be added as needed.

For feeds with high sulfur content, reducing the sulfur content to less than 50 ppm requires high temperatures and pressures, which makes catalytic hydrodesulfurization process very expensive. In addition, the severe operating conditions result in the rapid loss of catalyst activity, particularly for oils with high sulfur content.

There is a need for a lower cost process for removing sulfur from naphtha.

SUMMARY OF THE INVENTION

One aspect of the invention is a method for desulfurization of naphtha. In one embodiment, the method includes introducing a thermally or catalytically cracked naphtha stream containing sulfur compounds and a naphtha-immiscible ionic liquid into an ionic liquid desulfurization zone to remove a first portion of the sulfur compounds to form a mixture of reduced sulfur naphtha and a naphtha-immiscible ionic liquid containing the sulfur compounds; and introducing an effluent from the ionic liquid desulfurization zone and hydrogen into a catalytic hydrodesulfurization zone to remove a second portion of the sulfur compounds.

DETAILED DESCRIPTION OF THE INVENTION

A process has been developed in which a portion of the sulfur in a naphtha feed is removed using ionic liquids. The ionic liquid desulfurization part of the process can operate at low temperatures and pressures, reducing the capital and operating costs of desulfurization. In addition, a process utilizing ionic liquid desulfurization can further reduce costs because the catalytic hydrodesulfurizaton unit can be made smaller.

The naphtha feed can be any thermally or catalytically cracked naphtha. Suitable feeds include, but are not limited to naphtha from a fluid catalytic cracking unit, naphtha from delayed coker and visbreak units, and naphtha from thermal crackers.

Figure 1:
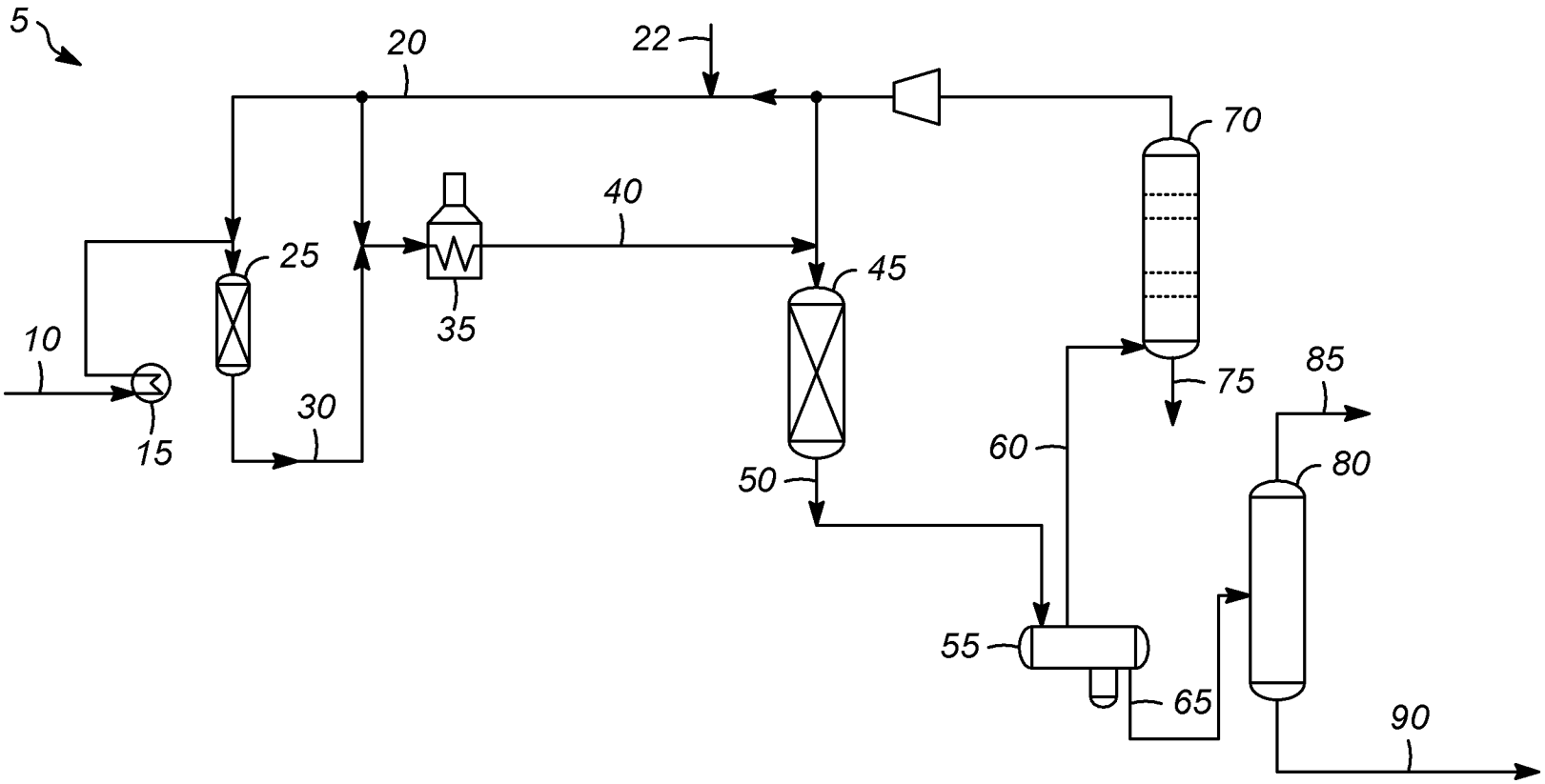
FIG. 1 illustrates one embodiment of a one stage catalytic hydrodesulfurization process.
Figure 2:
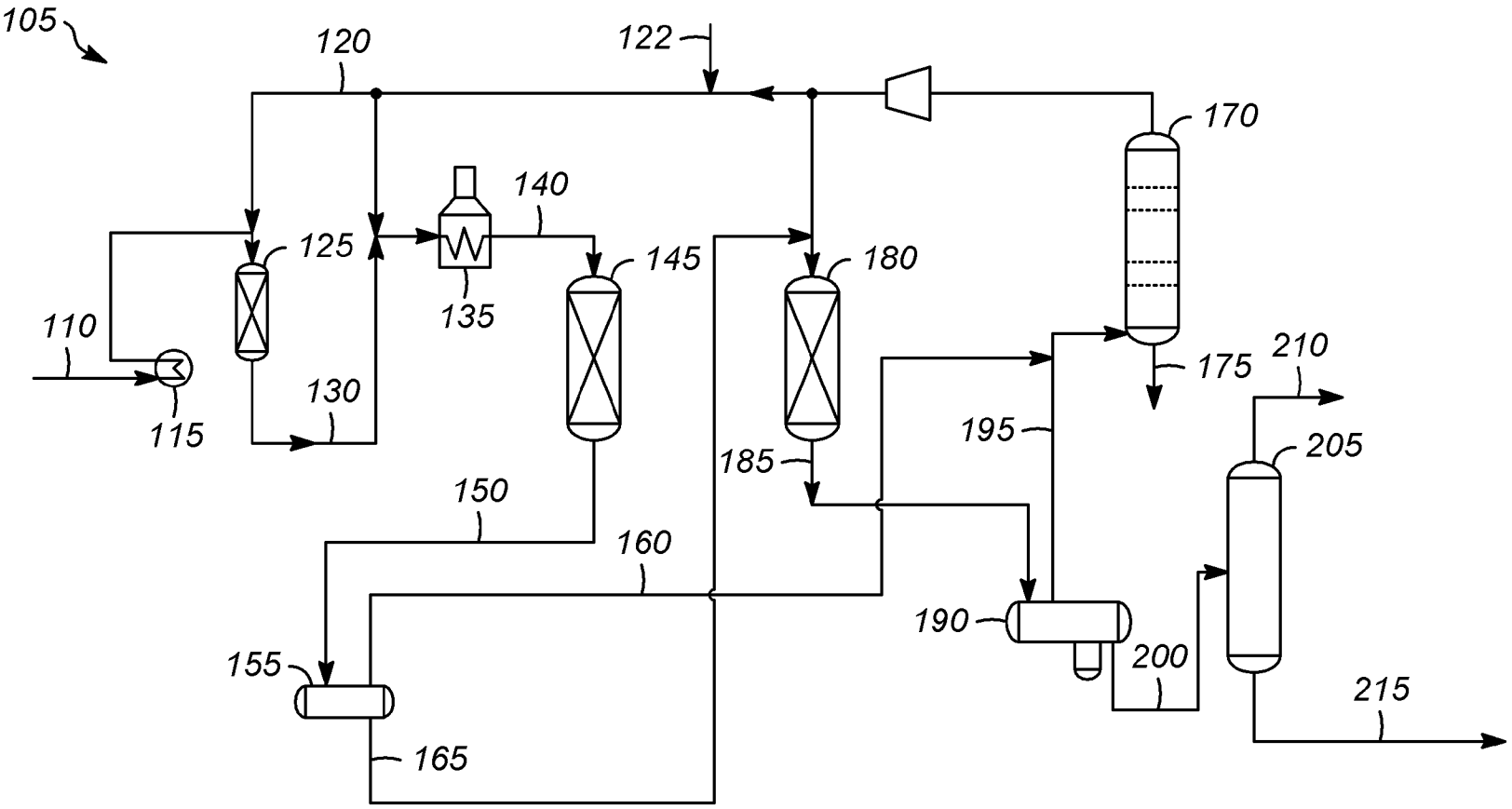
FIG. 2 illustrates one embodiment of a two stage catalytic hydrodesulfurization process.
Figure 3:
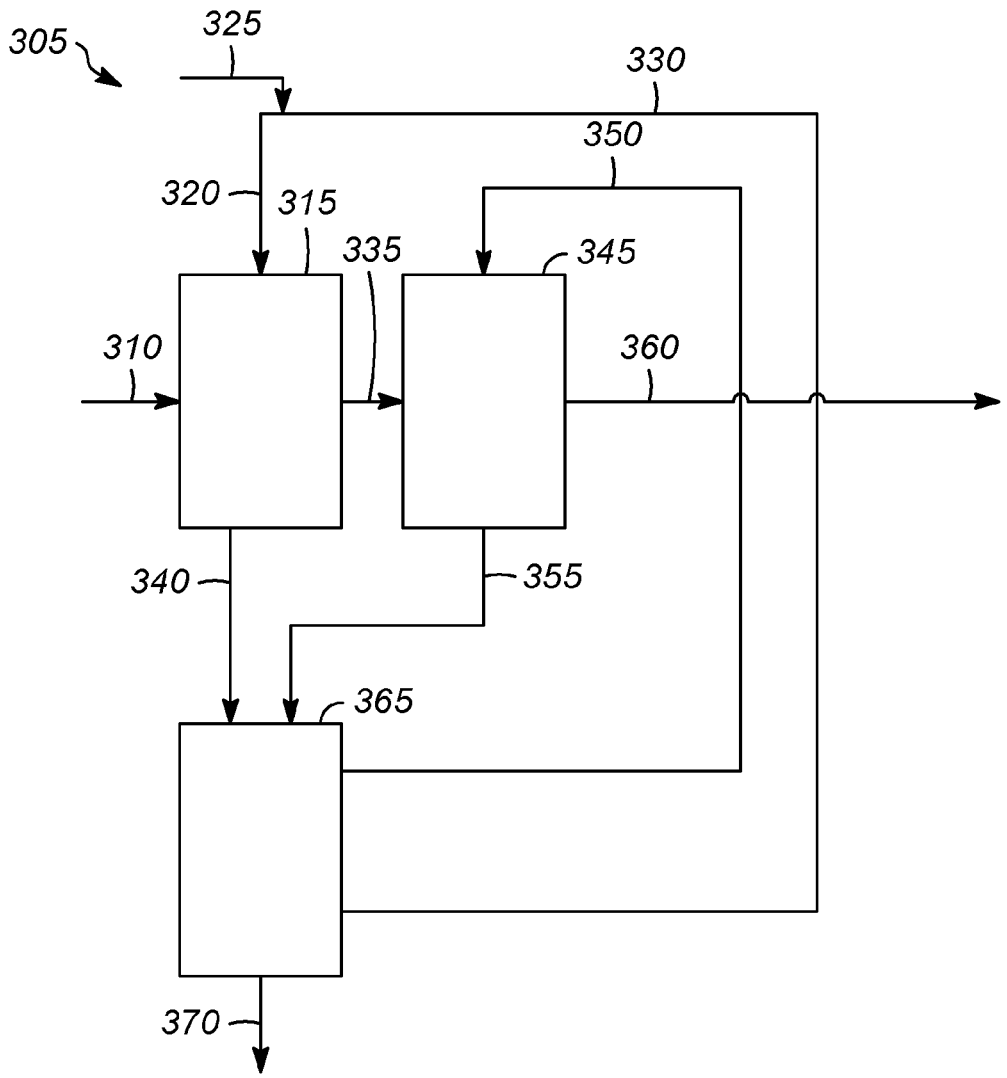
FIG. 3 illustrates one embodiment of an ionic liquid desulfurization unit.

One embodiment of an ionic liquid desulfurization zone 305 is illustrated in FIG. 3. In the embodiment shown in FIG. 3, the ionic liquid desulfurization zone 305 includes a contacting zone 315, an optional water washing zone 345, and an optional ionic liquid regeneration zone 365. As used herein, the term "zone" can refer to one or more equipment items and/or one or more sub-zones. Equipment items may include, for example, one or more vessels, heaters, separators, exchangers, conduits, pumps, compressors, and controllers. Additionally, an equipment item can further include one or more zones or sub-zones. The sulfur removal process or step may be conducted in a similar manner and with similar equipment as is used to conduct other liquid-liquid wash and extraction operations. Suitable equipment includes, for example, columns with: trays, packing, rotating discs or plates, and static mixers. Pulse columns and mixing/settling tanks may also be used.

The high sulfur-containing naphtha feed 310 is introduced into contacting zone 315 along with lean ionic liquid 320. The lean ionic liquid 320 can include fresh ionic liquid 325 and regenerated ionic liquid 330.

Ionic liquids suitable for use in the instant invention are naphtha-immiscible ionic liquids. As used herein the term "naphtha-immiscible ionic liquid" means the ionic liquid is capable of forming a separate phase from naphtha under the operating conditions of the process. Ionic liquids that are miscible with naphtha at the process conditions will be completely soluble with the naphtha; therefore, no phase separation will be feasible. Thus, naphtha-immiscible ionic liquids may be insoluble with or partially soluble with the hydrocarbon feed under the operating conditions. An ionic liquid capable of forming a separate phase from the naphtha under the operating conditions is considered to be naphtha-immiscible. Ionic liquids according to the invention may be insoluble, partially soluble, or completely soluble (miscible) with water.

In an embodiment, the naphtha-immiscible ionic liquid comprises at least one of an imidazolium ionic liquid, a pyridinium ionic liquid, and a phosphonium ionic liquid, and combinations thereof. In another embodiment, the hydrocarbon feed-immiscible ionic liquid consists essentially of imidazolium ionic liquids, pyridinium ionic liquids, phosphonium ionic liquids and combinations thereof. In still another embodiment, the naphtha-immiscible ionic liquid is selected from the group consisting of imidazolium ionic liquids, pyridinium ionic liquids, phosphonium ionic liquids and combinations thereof. Imidazolium and pyridinium ionic liquids have a cation comprising at least one nitrogen atom. Phosphonium ionic liquids have a cation comprising at least one phosphorous atom.

The ionic liquid comprises at least one ionic liquid from at least one of the following ionic liquids: tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halides.

In an embodiment, the naphtha-immiscible ionic liquid comprises at least one of 1-butyl-3-methylimidazolium chloride, 1-butyl-3-methylimidazolium trifluoromethanesulfonate, 1-butyl-4-methylpyridinium chloride, N-butyl-3-methylpyridinium methylsulfate, trihexyl(tetradecyl)phosphonium chloride, trihexyl(tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(ethyl)phosphonium diethylphosphate, tetrabutylphosphonium methanesulfonate, pyridinium p-toluene sulfonate.

The naphtha-immiscible ionic liquid may comprise at least one of 1-butyl-3-methylimidazolium trifluoromethanesulfonate, 1-butyl-4-methylpyridinium chloride, N-butyl-3-methylpyridinium methylsulfate, trihexyl(tetradecyl)phosphonium chloride, trihexyl(tetradecyl)phosphonium bromide, tributyl(hexyl)phosphonium chloride, tributyl(octyl)phosphonium chloride, tetrabutylphosphonium chloride, and tributyl(ethyl)phosphonium diethylphosphate.

Consistent with common terms of art, the ionic liquid introduced to the sulfur removal step may be referred to as a "lean ionic liquid" generally meaning a naphtha-immiscible ionic liquid that is not saturated with one or more extracted sulfur compounds. Lean ionic liquid may include one or both of fresh and regenerated ionic liquid and is suitable for accepting or extracting sulfur from the naphtha feed. Likewise, the ionic liquid effluent may be referred to as "rich ionic liquid", which generally means a naphtha-immiscible ionic liquid effluent produced by a sulfur removal step or process or otherwise including a greater amount of extracted sulfur compounds than the amount of extracted sulfur compounds included in the lean ionic liquid. A rich ionic liquid may require regeneration or dilution, e.g. with fresh ionic liquid, before recycling the rich ionic liquid to the same or another sulfur removal step of the process.

The sulfur removal step may be conducted under sulfur removal conditions including temperatures and pressures sufficient to keep the naphtha-immiscible ionic liquid and naphtha feeds and effluents as liquids. For example, the sulfur removal step temperature may range between about 10° C. and less than the decomposition temperature of the ionic liquid; and the pressure may range between about atmospheric pressure and about 700 kPa (g). When the naphtha-immiscible ionic liquid comprises more than one ionic liquid component, the decomposition temperature of the ionic liquid is the lowest temperature at which any of the ionic liquid components decompose. The sulfur removal step may be conducted at a uniform temperature and pressure or the contacting and separating steps of the sulfur removal step may be operated at different temperatures and/or pressures. In an embodiment, the contacting step is conducted at a first temperature, and the separating step is conducted at a temperature at least 5° C. lower than the first temperature. Such temperature differences may facilitate separation of the naphtha and ionic liquid phases.

The sulfur removal step conditions such as the contacting or mixing time, the separation or settling time, and the ratio of naphtha feed to naphtha-immiscible ionic liquid (lean ionic liquid) may vary greatly based, for example, on the specific ionic liquid or liquids employed, the nature of the naphtha feed (straight run or previously processed), the sulfur content of the naphtha feed, the degree of sulfur removal required, the number of sulfur removal steps employed, and the specific equipment used. In general it is expected that contacting time may range from less than one minute to about two hours; settling time may range from about one minute to about eight hours; and the weight ratio of naphtha feed to lean ionic liquid introduced to the sulfur removal step may range from 1:10,000 to 10,000:1. In an embodiment, the weight ratio of naphtha feed to lean ionic liquid may range from about 1:1,000 to about 1,000:1; and the weight ratio of naphtha feed to lean ionic liquid may range from about 1:100 to about 100:1. In an embodiment the weight of naphtha feed is greater than the weight of ionic liquid introduced to the sulfur removal step.

The feed 310 and lean ionic liquid 320 are contacted in the contacting zone 315 forming a naphtha stream 335 having a reduced sulfur level, and a rich ionic liquid stream 340 containing sulfur compounds.

In one embodiment, the contacting zone 315 includes a mixer/settler in which the feed 310 and the lean ionic liquid 320 are mixed and then allowed settle, forming two phases: the naphtha stream 335 having a reduced sulfur level, and the rich ionic liquid stream 340 containing sulfur compounds.

In another embodiment, the contacting zone 315 includes a countercurrent extraction column. The feed 310 and lean ionic liquid 320 flow countercurrently and the sulfur compounds are transferred from the feed to the rich ionic liquid.

The reduced sulfur naphtha stream 335 can be sent to the optional water washing zone 345 to recover ionic liquid that is entrained or otherwise remains in the reduced sulfur naphtha stream 335. A portion or all of the reduced sulfur naphtha stream 335 and a water stream 350 are sent to the water washing zone 345 where it is mixed with the water stream 350 and then separated into a washed reduced sulfur naphtha product stream 360 and a spent water stream 355 which contains the ionic liquid. The water washing step can be performed using any suitable equipment and conditions used to conduct other liquid-liquid wash and extraction operations.

If desired, the rich ionic liquid stream 340 can be sent to an optional regeneration zone 365 to regenerate the rich ionic liquid by removing the sulfur compound from the ionic liquid. The rich ionic liquid can be regenerated in any suitable manner. Current methods of regenerating ionic liquids include, but are not limited to, washing with a regenerating solvent, steam stripping, or combinations thereof.

In one embodiment, all or a portion of the rich ionic liquid stream 340 containing the sulfur compound is sent to the regeneration zone 365. If the regeneration solvent is water, the rich ionic liquid stream 340 can mixed with water stream 355 from the water washing zone 345 and separated into an extract stream 370 comprising the sulfur compound and an ionic liquid/water mixture which can then be separated into water stream 350 and regenerated lean ionic liquid stream 330.

The extract stream 370 can be recovered and further processed to recover the hydrocarbon in the extract stream. For example, the extract stream 370 can be sent to a hydrotreating zone where hydrogen gas is contacted with hydrocarbon in the in the presence of suitable catalysts which are primarily active for the removal of heteroatoms, such as sulfur. In hydrotreating, hydrocarbons with double and triple bonds may be saturated. Aromatics may also be saturated. Some hydrotreating processes are specifically designed to saturate aromatics. Cloud point of the hydrotreated product may also be reduced. Any conventional catalysts for hydrotreating can be used. Suitable hydrotreating catalysts include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. More than one type of hydrotreating catalyst can be used.

The regenerated ionic liquid stream 330 can be recycled to the contacting zone 315, if desired. The ionic liquid regeneration step can be performed using any suitable equipment and conditions used to conduct other liquid-liquid wash and extraction operations.

The regeneration solvent can be separated from the regenerated ionic liquid by any suitable method. When the regeneration solvent is water, the water can be removed by well known methods such as including distillation, flash distillation, and using a dry inert gas to strip water. Generally, the drying temperature may range from about 100° C. to less than the decomposition temperature of the ionic liquid, usually less than about 300° C. The pressure may range from about 35 kPa (g) to about 250 kPa (g).

Another method of regenerating the ionic liquid is steam stripping. Steam is introduced into a column along with ionic liquid stream 340 containing the sulfur compound and optionally spent water from the water washing zone. Generally, the regeneration temperature in the column is at least about 175° C., and preferably greater than about 200° C. The water with the sulfur compounds is removed overhead, and the ionic liquid is recovered in the bottoms. Suitable steam stripping methods and apparatus are described in U.S. Pat. No. 8,127,938 and U.S. Pat. No. 8,383,538, which are incorporated herein by reference.

Figure 4:
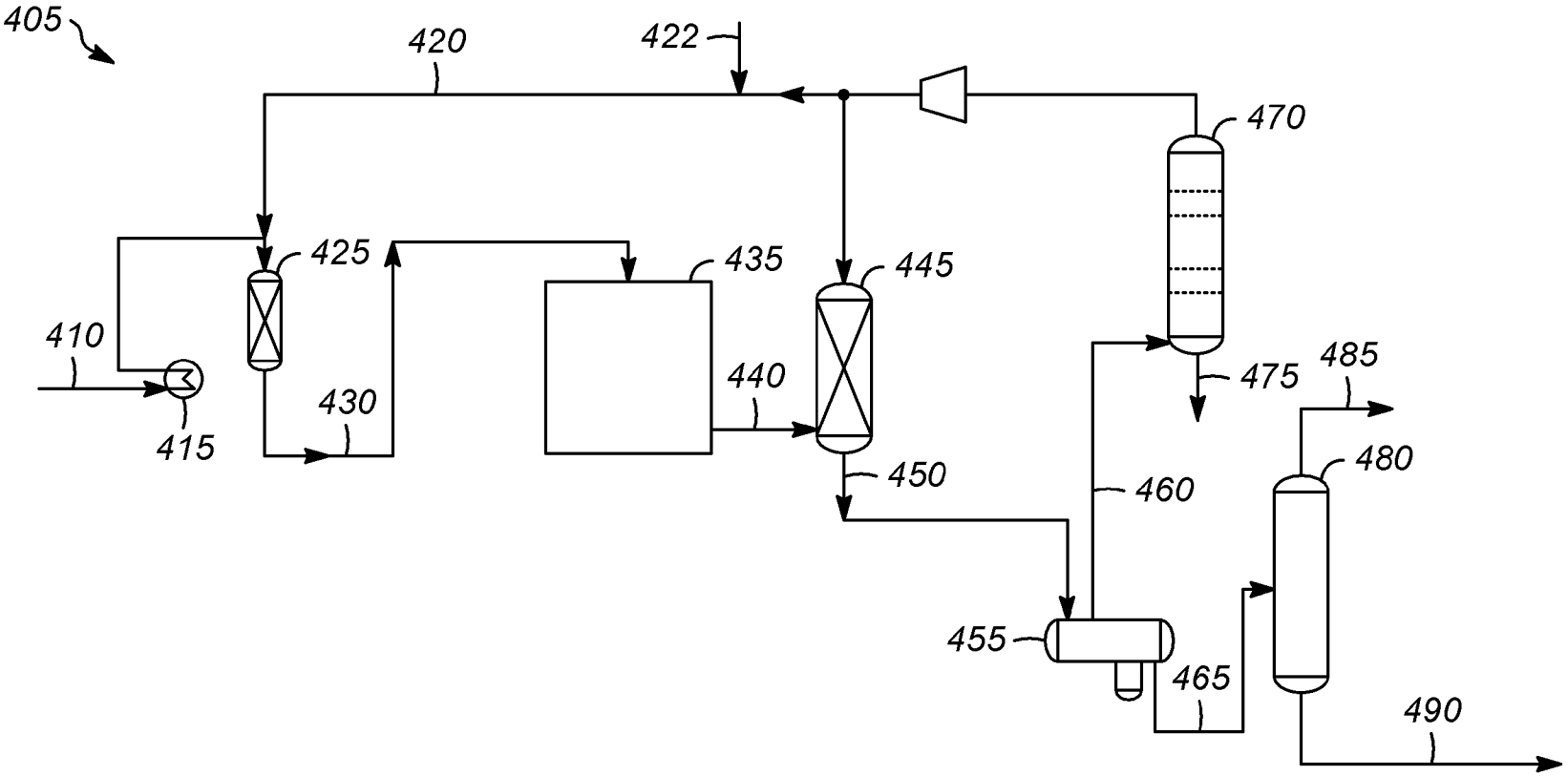
FIG. 4 illustrates another embodiment of an ionic liquid desulfurization process.

FIG. 4 illustrates one embodiment of a two stage ionic liquid/catalytic hydrodesulfurization process 405 which combines an ionic liquid desulfurization zone 435 with a catalytic hydrodesulfurization reactor 445. This arrangement would be used when an ionic liquid desulfurization zone does not remove sufficient sulfur to meet the sulfur specification.

If removal of dienes from the feed is needed, the feed 410 is preheated in a heat exchanger 415 and mixed with hydrogen 420. The feed 410 and hydrogen 420 are introduced into reactor 425 where any dienes present are saturated. If the level of dienes in the feed is less than about 0.5 as measured by UOP Method 326-08, the saturation step is not required. A higher diene value could be tolerated when a regenerating solvent is used because the regenerating solvent works at lower regeneration temperatures, which results in less reaction of dienes and provides a method to remove dienes and their reaction products into the extract. For example, it may be permissible to have feeds with a diene value up to 3 when a regenerating solvent is used.

The effluent 430 from the reactor 425 is sent to the ionic liquid desulfurization zone 435 where the sulfur content is reduced. The effluent 440 and hydrogen 420 are sent to a catalytic hydrodesulfurization reactor 445 where the sulfur content is further reduced. The effluent 450 is sent to product separator 455 where the hydrogen rich gas 460 is separated from the low sulfur liquid 465. The hydrogen rich gas 460 is sent to the recycle gas scrubber 470 for hydrogen sulfide removal, and the hydrogen 420 is recycled back to the reactor. Hydrogen sulfide is removed in stream 475. The low sulfur liquid 465 is sent to a debutanizer 480 where the light ends 485 are separated from the low sulfur naphtha 490. In this arrangement, the catalytic hydrodesulfurization reactor 445 can be smaller than in a conventional catalytic hydrodesulfurization process because the ionic liquid desulfurization unit has already removed a portion of the sulfur from the naphtha.

Figure 5:
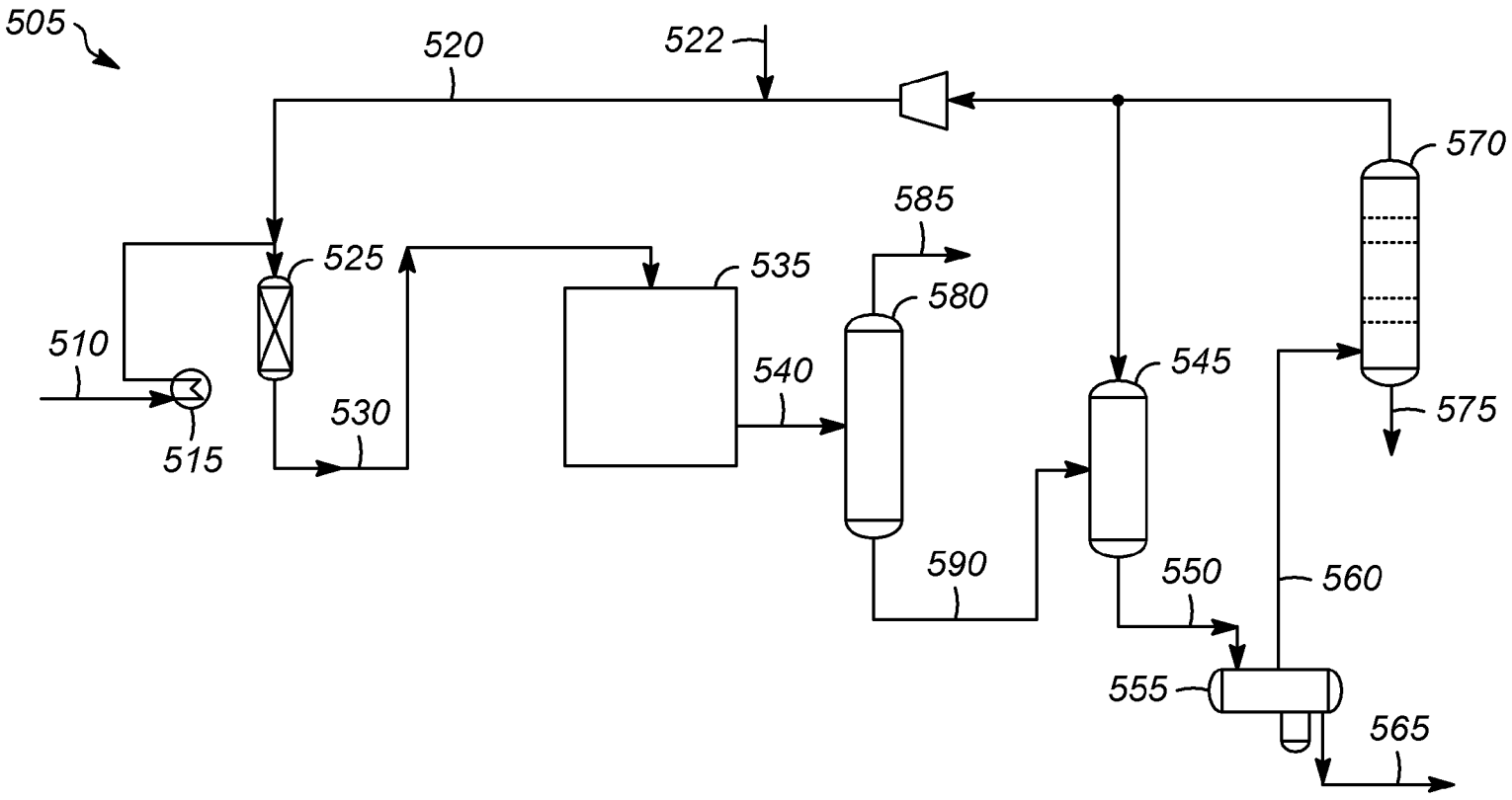
FIG. 5 illustrates another embodiment of an ionic liquid desulfurization process.

FIG. 5 illustrates another embodiment of a two stage ionic liquid/catalytic hydrodesulfurization process 505. In this arrangement, a fractionator 580 is placed between the ionic liquid desulfurization unit 535 and the catalytic hydrodesulfurization reactor 545 to reduce the amount of naphtha sent to the catalytic hydrodesulfurization reactor. The feed 510 is preheated in a heat exchanger 515 and mixed with hydrogen 520. The feed 510 and hydrogen 520 are introduced into reactor 525 where any dienes present are saturated. The effluent 530 is sent to the ionic liquid desulfurization unit 535 where the sulfur content is reduced. The effluent 540 is sent to the fractionator 580 where low sulfur naphtha 585 is separated from bottoms stream 590, which is mixed with hydrogen 520 and sent to a catalytic hydrodesulfurization reactor 545 where the sulfur content is further reduced. The effluent 550 is sent to product separator 555 where the hydrogen rich gas 560 is separated from the low sulfur liquid 565. The hydrogen rich gas 560 is sent to the recycle gas scrubber 570 for hydrogen sulfide removal. Hydrogen sulfide is removed in stream 575. The low sulfur liquid 565 can then be recovered.

In the fractionation step, a higher amount of naphtha, which will contain all of the light olefins that are the main contributors of RON, can be drawn from the top of the fractionation column so that it does not enter the catalytic hydrodesufurization reactor. The hydrogen consumption and octane loss can be minimized because the fractionator bottoms entering the catalytic hydrodesufurization reactor is small. The fractionator bottoms stream can be adjusted to the extent required to meet the final sulfur specification of the pool by adjusting the withdrawal rate from the top and the side draw.

The catalytic hydrodesulfurization zone contains a typical hydrodesulfurization catalyst and is maintained at typical hydrodesulfurization conditions.

The catalytic hydrodesulfurization zone may contain a fixed, ebullated, or fluidized catalyst bed. This reaction zone is preferably maintained under an imposed pressure from about 0 kPa gauge (atmospheric) to about 13790 kPa gauge (2000 psig) and more preferably under a pressure from about 689 kPa gauge (100 psig) to about 12411 kPa gauge (1800 psig). Suitably, the hydrodesulfurization reaction is conducted with a maximum catalyst bed temperature in the range from about 204° C. (400° F.) to about 400° C. (750° F.) selected to perform the desired hydrodesulfurization conversion to reduce the concentration of the sulfur compounds to the desired level. Further preferred operating conditions include liquid hourly space velocities in the range from about 0.05 $hr^{-1}$ to about 20 $hr^{-1}$ and hydrogen to feed ratios from about 200 standard cubic feet per barrel (SCFB) to about 50,000 SCFB, preferably from about 200 SCFB to about 10,000 SCFB. The hydrodesulfurization zone operating conditions are preferably selected to produce a desulfurized hydrocarbonaceous oil containing less than about 50 wppm sulfur.

The preferred catalytic composite disposed within the hereinabove-described hydrodesulfurization zone can be characterized as containing a metallic component having hydrodesulfurization activity, which component is combined with a suitable refractory inorganic oxide carrier material of either synthetic or natural origin. The precise composition and method of manufacturing the carrier material are not considered essential to the present invention. Preferred carrier materials are alumina, silica, and mixtures thereof. Suitable metallic components having hydrodesulfurization activity are those selected from the group comprising the metals of Groups VIB and VIII of the Periodic Table. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically-active metallic component, or components, is primarily dependent upon a particular metal as well as the physical and/or chemical characteristics of the particular hydrocarbon feedstock. For example, the metallic components of Group VIB are generally present in an amount within the range of from about 1 to about 20 weight percent, the iron-group metals in an amount within the range of about 0.2 to about 10 weight percent, whereas the noble metals of Group VII are preferably present in an amount within the range of from about 0.1 to about 5 weight percent, all of which are calculated as if these components existed within the catalytic composite in the elemental state. In addition, any catalyst employed commercially for hydrodesulfurizing middle distillate hydrocarbonaceous compounds to remove nitrogen and sulfur may function effectively in the hydrodesulfurization zone of the present invention. It is further contemplated that hydrodesulfurization catalytic composites may comprise one or more of the following components: cesium, francium, lithium, potassium, rubidium, sodium, copper, gold, silver, cadmium, mercury and zinc.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method for desulfurization of naphtha comprising:

introducing a thermally or catalytically cracked naphtha stream containing sulfur compounds and a naphtha-immiscible ionic liquid into an ionic liquid desulfurization zone to remove a first portion of the sulfur compounds to provide an effluent comprising naphtha having reduced sulfur and a naphtha-immiscible ionic liquid containing the sulfur compounds; and introducing the effluent comprising naphtha having reduced sulfur from the ionic liquid desulfurization zone and hydrogen into a catalytic hydrodesulfurization zone to remove a second portion of the sulfur compounds.

2. The method of claim 1 further comprising: separating an effluent from the catalytic hydrodesulfurization zone into a low sulfur liquid component and a sulfur containing gas component.

3. The method of claim 2 further comprising separating the low sulfur liquid component into a low sulfur naphtha stream and a low sulfur lights ends stream, and recovering the low sulfur naphtha stream.

4. The method of claim 2 further comprising removing sulfur from the sulfur containing gas component.

5. The method of claim 1 further comprising:

separating the effluent comprising naphtha from the ionic liquid desulfurization zone into a low sulfur naphtha overhead stream and a bottoms stream before introducing the effluent comprising naphtha from the ionic liquid desulfurization zone into the catalytic hydrodesulfurization zone, wherein introducing the effluent comprising naphtha from the ionic liquid desulfurization zone into the catalytic hydrodesulfurization zone comprises introducing the bottoms stream into the catalytic hydrodesulfurization zone;

separating an effluent from the catalytic hydrodesulfurization zone into a low sulfur liquid component and a sulfur containing gas component; and recovering the low sulfur liquid component.

6. The method of claim 1 wherein the thermally or catalytically cracked naphtha stream contains diolefins, and further comprising introducing the thermally or catalytically cracked naphtha stream and hydrogen to a stabilization zone to saturate the diolefin compounds before the thermally or catalytically cracked naphtha stream is introduced into the ionic liquid desulfurization zone.

7. The method of claim 1 wherein the naphtha-immiscible ionic liquid comprises at least one of an imidazolium ionic liquid, a phosphonium ionic liquid, and a pyridinium ionic liquid.

8. The method of claim 1 wherein the naphtha-immiscible ionic liquid comprises at least one of 1-ethyl-3-methylimidazolium ethyl sulfate, 1-butyl-3-methylimidazolium hydrogen sulfate, 1-ethyl-3-methylimidazolium chloride, 1-butyl-3-methylimidazolium chloride, tetrabutylphosphonium methane sulfonate, pyridinium p-toluene sulfonate, tetrabutylphosphonium chloride, tetrabutylphosphonium bromide, tributyl(octyl)phosphonium chloride, and tributyl(ethyl) phosphonium diethylphosphate, 1-butyl-3-methylimidazolium trifluoromethanesulfonate, 1-butyl-4-methylpyridinium chloride, N-butyl-3-methylpyridinium methyl sulfate, trihexyl(tetradecyl)phosphonium chloride, trihexyl (tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(decyl)phosphonium bromide, tributyl(decyl)phosphonium chloride, triisobutyl(methyl)phosphonium tosylate, and tetrabutylphosphonium methanesulfonate.

9. The method of claim 1 further comprising regenerating the naphtha-immiscible ionic liquid stream containing the sulfur compounds.

10. The method of claim 9 wherein regenerating the naphtha-immiscible ionic liquid stream containing the sulfur compounds comprises:

contacting the naphtha-immiscible ionic liquid stream containing the sulfur compounds with a regeneration solvent; and separating the naphtha-immiscible ionic liquid stream from the regeneration solvent to produce an extract stream comprising the sulfur compounds and a regenerated naphtha-immiscible ionic liquid stream.

11. The method of claim 9 wherein regenerating the naphtha-immiscible ionic liquid stream containing the sulfur compounds comprises separating the naphtha-immiscible ionic liquid stream by steam stripping to produce the extract stream comprising the sulfur compounds and the regenerated naphtha-immiscible ionic liquid stream.

12. A method for desulfurization of naphtha comprising:

introducing a thermally or catalytically cracked naphtha stream containing sulfur compounds and a naphtha-immiscible ionic liquid into an ionic liquid desulfurization zone to remove a first portion of the sulfur compounds to provide an effluent comprising naphtha having reduced sulfur and a naphtha-immiscible ionic liquid containing the sulfur compounds;

introducing the effluent comprising naphtha having reduced sulfur from the ionic liquid desulfurization zone and hydrogen into a catalytic hydrodesulfurization zone to remove a second portion of the sulfur compounds;

separating an effluent from the catalytic hydrodesulfurization zone into a low sulfur liquid component and a sulfur containing gas component; and regenerating the naphtha-immiscible ionic liquid containing the sulfur compounds by steam stripping to produce the extract stream comprising the sulfur compounds and the regenerated naphtha-immiscible ionic liquid stream.

13. The method of claim 12 further comprising: separating the low sulfur liquid component into a low sulfur naphtha stream and a low sulfur lights ends stream.

14. The method of claim 12 further comprising:

separating the effluent from the ionic liquid desulfurization zone into a low sulfur naphtha overhead stream and a bottoms stream before introducing the effluent from the ionic liquid desulfurization zone into the catalytic hydrodesulfurization zone, wherein introducing the effluent from the ionic liquid desulfurization zone into the catalytic hydrodesulfurization zone comprises introducing the bottoms stream into the catalytic hydrodesulfurization zone;

separating an effluent from the catalytic hydrodesulfurization zone into a low sulfur liquid component and a sulfur containing gas component; and recovering the low sulfur liquid component.

15. The method of claim 12 further comprising removing sulfur from the sulfur containing gas component.

16. The method of claim 12 wherein the thermally or catalytically cracked naphtha stream contains diolefins, and further comprising introducing the thermally or catalytically cracked naphtha stream and hydrogen to a stabilization zone to saturate the diolefin compounds before the thermally or catalytically cracked naphtha stream is introduced into the ionic liquid desulfurization zone.

17. The method of claim 12 wherein the naphtha-immiscible ionic liquid comprises at least one of an imidazolium ionic liquid, a phosphonium ionic liquid, and a pyridinium ionic liquid.

18. The method of claim 12 wherein the naphtha-immiscible ionic liquid comprises at least one of 1-ethyl-3-methylimidazolium ethyl sulfate, 1-butyl-3-methylimidazolium hydrogen sulfate, 1-ethyl-3-methylimidazolium chloride, 1-butyl-3-methylimidazolium chloride, tetrabutylphosphonium methane sulfonate, pyridinium p-toluene sulfonate, tetrabutylphosphonium chloride, tetrabutylphosphonium bromide, tributyl(octyl)phosphonium chloride, and tributyl (ethyl)phosphonium diethylphosphate, 1-butyl-3-methylimidazolium trifluoromethanesulfonate, 1-butyl-4-methylpyridinium chloride, N-butyl-3-methylpyridinium methyl sulfate, trihexyl(tetradecyl)phosphonium chloride, trihexyl (tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(decyl)phosphonium bromide, tributyl(decyl)phosphonium chloride, triisobutyl(methyl)phosphonium tosylate, and tetrabutylphosphonium methanesulfonate.

* * * * *